United States Patent [19]

Glerum

[11] Patent Number: 4,997,125

[45] Date of Patent: Mar. 5, 1991

[54] CYLINDRICAL CONTAINER

[75] Inventor: Johannes A. Glerum, Deventer, Netherlands

[73] Assignee: Thomassen & Drijver-Verblifa N.V., AJ Deventer, Netherlands

[21] Appl. No.: 815,314

[22] Filed: Jan. 2, 1986

Related U.S. Application Data

[63] Continuation of Ser. No. 555,360, Nov. 28, 1983, abandoned.

[30] Foreign Application Priority Data

Dec. 3, 1982 [NL] Netherlands ..... 8204692

[51] Int. Cl.[5] ..... B65D 3/22

[52] U.S. Cl. ..... 229/4.5; 220/460; 220/453; 220/646; 229/199

[58] Field of Search ..... 229/4.5, 199; 220/453, 220/460, 646

[56] References Cited

U.S. PATENT DOCUMENTS

| | | | |
|---|---|---|---|
| 2,181,905 | 12/1935 | McCrery | 229/4.5 X |
| 2,280,501 | 4/1942 | Stephenson | 220/71 |
| 2,810,492 | 10/1957 | Bergen et al. | 220/453 |
| 2,954,803 | 10/1960 | Barnes et al. | 229/4.5 |
| 3,179,286 | 4/1965 | Morceau | 220/460 |
| 3,423,009 | 1/1969 | Palmer | 229/4.5 X |
| 3,501,047 | 3/1970 | Raabe | 220/71 |
| 4,023,700 | 5/1977 | Buquet et al. | 220/71 |
| 4,471,900 | 9/1984 | Kadunce | 229/4.5 |

FOREIGN PATENT DOCUMENTS

| | | | |
|---|---|---|---|
| 803715 | 10/1936 | France . | |
| 488410 | 12/1953 | Italy | 229/4.5 |
| 6603444 | 9/1966 | Netherlands . | |
| 492163 | 9/1938 | United Kingdom | 229/4.5 |
| 532764 | 1/1941 | United Kingdom . | |

OTHER PUBLICATIONS

*Distribution Packaging*, by Friedman and Kipnees, pp. 372, 373, 1977.

*Primary Examiner*—Gary E. Elkins
*Attorney, Agent, or Firm*—Watson, Cole, Grindle & Watson

[57] ABSTRACT

The invention relates to a cylindrical container comprising a bottom, a cylindrical body and a lid.

The invention has for its object to design a container of the kind set forth so that it satisfies requirements with respect to strength and stackability and can, moreover, be manufactured at economically permissible, additional costs. According to the invention the container comprises a reinforcing layer fixed to the surface of at least the central zone of the body throughout the circumference thereof.

It is preferred to use a container whose reinforcing layer is fixed to the entire body surface.

3 Claims, 2 Drawing Sheets

CYLINDRICAL CONTAINER

This application is a continuation of application Ser. No. 555,360, filed 11/28/83 now abandoned.

The invention relates to a cylindrical container comprising a bottom, a cylindrical body and a lid.

Such a cylindrical container is known. The problem involved in such a container is that when cooled after pasteurization or sterilization heating or after filling with hot ware subatmospheric pressure is caused in the container so the atmospheric pressure can depress the container wall if it is not sufficiently rigid. For technical and commercial reasons such a deformation is not acceptable. Technically it is not allowed, for example, for the bottom and the lid not to be parallel to one another, since this would adversely affect the stackability of identical containers, which might give rise to disturbances when filling boxes with containers. Commercially a deformed container is not acceptable with regard to presentation.

In order to impart the required strength to a container it is common practice to enlarge the wall thickness which is a commercially little attractive, but unavoidable solution.

The invention has for its object to design a container of the kind set forth so that it satisfies the requirements with respect to strength and can, moreover, be manufactured at economically permissible, additional costs. According to the invention the container described is characterized in that a reinforcing layer is fixed to the surface of at least the central zone of the body throughout the circumference thereof. It is noted here by way of explanation that the central zone is the most critical zone, that is to say, the zone most susceptible to deformation due to atmospheric pressure.

It is, however, preferred to use a container whose reinforcing layer is fixed to the entire body surface.

In a given embodiment the fixation between the reinforcing layer and the body surface is of a continuous nature.

In order to save adhesive a variant may be used in which the fixation of the reinforcing layer to the body surface is of a discrete nature and is obtained by a fine raster of adhering surfaces.

For example, the reinforcing layer may be glued to the body surface.

For example, the reinforcement may be obtained by a rigid cylinder which is slipped onto the body after, for example, glue is applied to the zone to be glued.

The reinforcing layer may be applied to the body surface by winding. In this case the protective layer preferably consists of a lamina of wrappers. The layers should firmly adhere to one another.

When the protective layer is applied to the outer surface of the body it is advantageous to use the outer surface of the protective layer as a label.

The invention further encompasses a method of manufacturing a cylindrical container comprising a bottom, a cylindrical body and a lid, said container being closed prior to cooling after pasteurization or sterilization heating or after filling with hot water, in which method prior to cooling of the filled and closed container a reinforcing layer is stuck to the surface of at least the central zone of the body throughout the circumference thereof.

It is noted in accordance with the invention that the reinforcing layer in itself need not have an extreme resistance to bending. A material which is rather flexible as compared with the material of the body of the container can ensure together with the wall the required strength owing to the "sandwich" structure with the wall.

It is furthermore noted that there is basically no difference whether the reinforcing layer is applied to the inner surface or to the outer surface of the container body. In the embodiments mentioned above, in which the reinforcing layer is wrapped around the body, the layer is, of course, located on the outer surface.

The invention will now be described more fully with reference to the drawing of a few embodiments. The drawing shows in FIG. 1 a schematic, perspective view of a container, the body of which has a continuous adhering layer, FIG. 2 a view like FIG. 1 of a container in which the layer is formed by a fine raster of adhering surfaces, FIG. 3 a perspective view of a container in which a reinforcing layer is stuck to the surface of the central zone, FIG. 4 a perspective view of a container, the whole body of which is provided with an adhering layer, FIG. 5 a continuous, rigid cylinder, FIG. 6 a rigid cylinder with a seam, FIG. 7 a container embodying the invention, around which an adhering layer formed by a wrapper is applied, FIG. 8 a perspective view of a container around which a wrapper provided with an adhesive layer is applied as a protective layer, FIG. 9 a drastically schematic view of a device for manufacturing a container embodying the invention and FIG. 10 a perspective view of a production stage of the device shown in FIG. 9.

FIG. 1 shows a container 1 comprising a bottom 2, a cylindrical body 3 and a lid 4, the central zone of said body 3 being provided with an adhesive layer 5 for sticking a protective layer to the body 3. The adhesive layer 5 is of a continuous nature.

FIG. 2 shows the container 1, in which the central zone of the body has an adhesive layer 6 of discrete nature formed by a fine raster of adhering surfaces.

FIG. 3 shows the container 1 provided with a reinforcing layer 7 fixed to the adhesive layer 5 or 6. The reinforcing layer has an overlapping zone 8 in which two reinforcing layers are stuck to one another.

Figure 1:
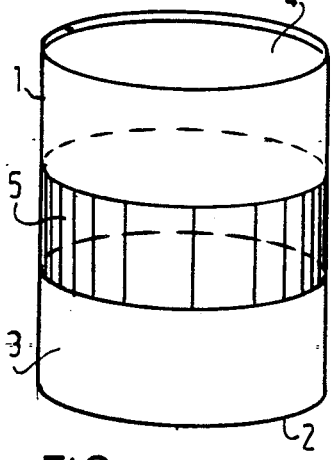
Figure 2:
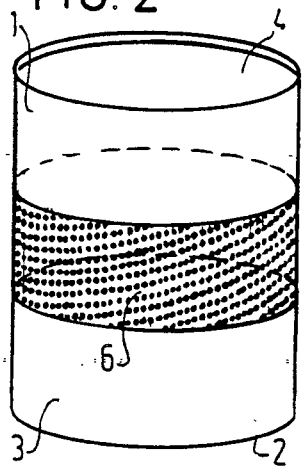
Figure 3:
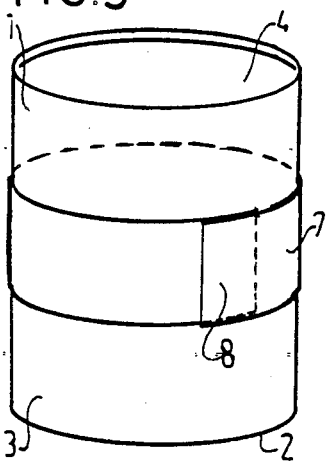
Figure 4:
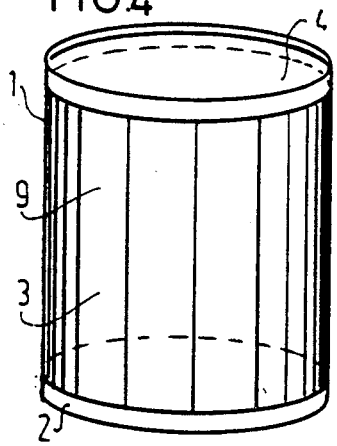
FIG. 4 shows the container 1, the entire body surface of which is provided with a continuous adhesive layer 9.
Figure 5:
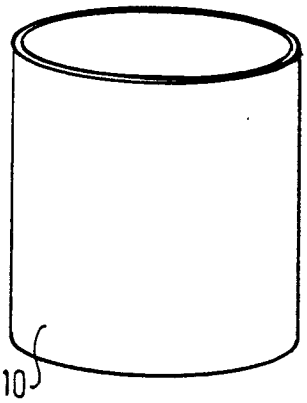
FIG. 5 shows an uninterrupted, rigid cylinder 10, which can be slipped onto the container 1 shown in FIG. 4.
Figure 6:
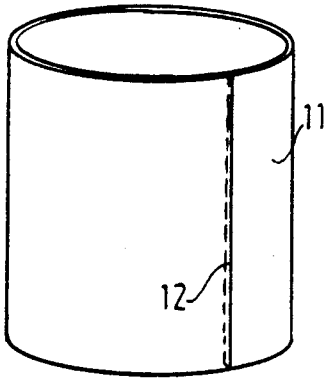

FIG. 6 shows a rigid cylinder 11 with a seam 12, which can also be slipped onto the container 1 shown in FIG. 4.

Figure 7:
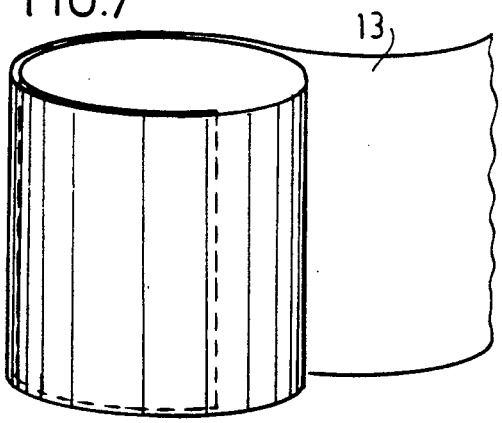

FIG. 7 shows a reinforcing layer in the form of a wrapper 13 during the assembling operation.

Figure 8:
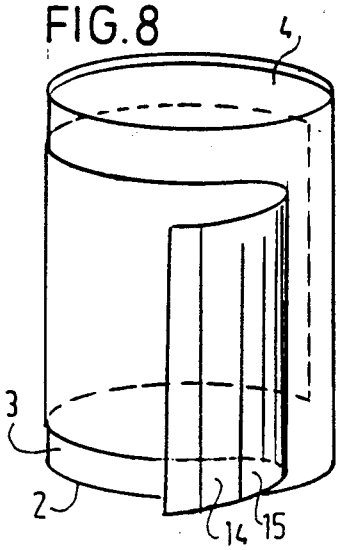

FIG. 8 shows a container 1 around which is arranged a wrapper previously provided with an adhesive layer 14.

Figure 9:
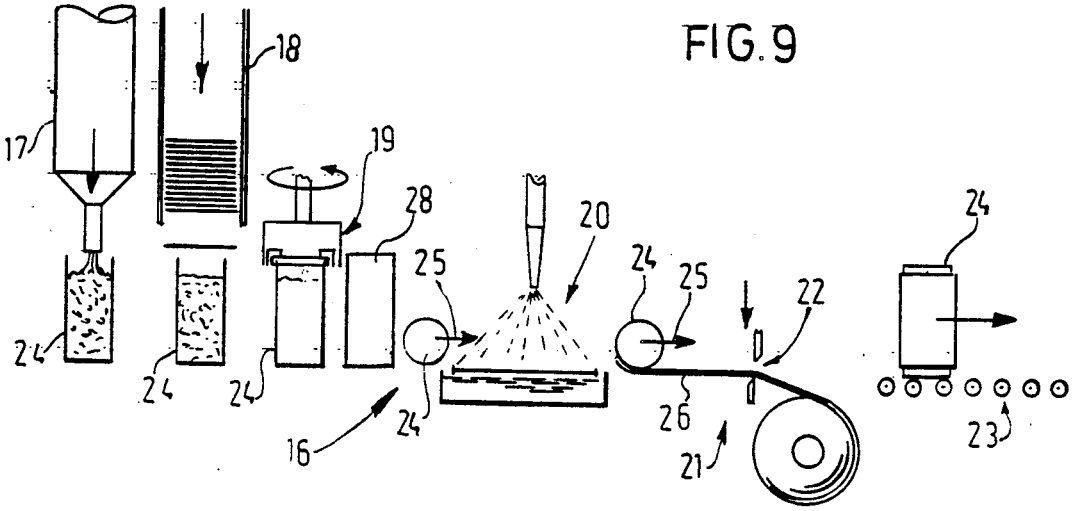

FIG. 9 is a drastically schematic view of a device 16 comprising a hot ware feeding funnel 17, a station 18 for supplying the individual lids, a device 19 for closing the container with a lid and a heating device 28 constructed in the form of an autoclave, whilst in a device 20 a layer of glue can be applied to the whole body surface of the container. A wrapping device 21 sticks a reinforcing layer around the container, which layer can be cut by a cutting device 22, after the ready container can be conducted away on a roller track 23.

The container supplied 24 is filled by energizing the feeding funnel 17, then transported by means not shown to the device 18, which supplies a lid, which is fixed to the filled container by a bead or flange operation in a manner such that the container is hermetically closed after the container 24 is transported to the device 19. Subsequently, as is illustrated in the drawing, the container 24, after being heated in the autoclave 28 is tilted through 90° by means not shown, after which it rolls in the direction of the arrow 25 along a track 20, whilst by energizing the gluing device 20 the body surface is provided with a layer of glue. After the device 20 the rolling container comes into contact with a ready wrapping part 26, which sticks by the glue applied to the outer surface of the container 24 so that it forms the reinforcing layer. After the wrapper is cut to the correct length by the cutting device 22 and after the wrapping part 26 has completely stuck to the outer surface of the body the container when tilted can be transported further by the roller track 23.

Figure 10:
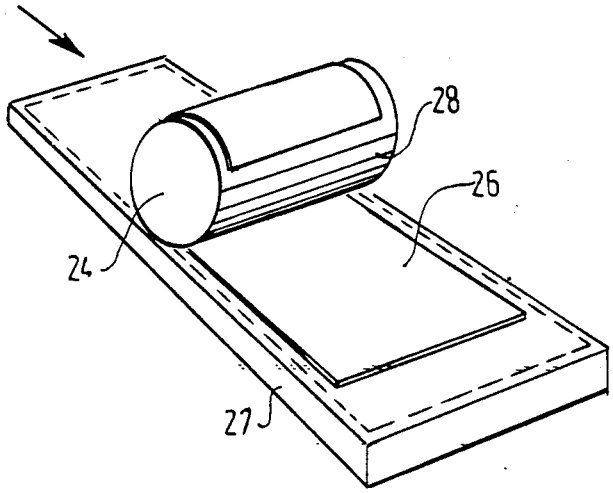

FIG. 10 shows a wrapping table 27 holding the wrapper 26 across which rolls the container 24 with the outer surface provided with a layer of glue.

It will be obvious that the reinforcing layer should be applied before any excessive pressure difference between the open air and the interior of the container is produced, that is to say, before the container has cooled too much.

The invention is not limited to the embodiments described and illustrated. For example, a protective synthetic resin layer may be sprayed to the body surface of the filled container in a spraying device.

I claim:

1. A new article of manufacture comprising a container having a cylindrical wall of uniform, circular cross-section and having a bottom at one end of the cylindrical wall and closing said one end of the cylindrical wall to form a cylinder closed and reinforced by said bottom at said one end and open at the other end thereof, a heated product within the confines of the space defined by the cylindrical wall and the bottom, a circular lid hermetically joined around its periphery to the other end of said cylindrical wall in parallel relation to said bottom to seal said heated product within the container and for reinforcing said wall at said other end thereof, said circumferential wall having a thickness insufficient to withstand buckling force, between said bottom and said lid, after the heated product has cooled to ambient temperature, and reinforcing means for cooperating with said wall to withstand said buckling forces, said reinforcing means comprising a relatively flexible reinforcing layer which is more flexible than said wall and embracing the outer surface of said wall in completely surrounding relation thereto and in covering relation to at least the central zone of said wall between said bottom and said lid and an adhesive interlayer fixing said reinforcing layer to said outer surface of the wall to form a sandwich comprising said wall, said reinforcing layer and the adhesive interlayer, the sandwich having sufficient rigidity to withstand said buckling forces and prevent deformation of the cylindrical wall which would destroy said parallel relation between said lid and said bottom when the product has cooled to ambient temperature.

2. A cylindrical container as defined in claim 1 wherein said adhesive interlayer is applied as a fine raster to the surface portion of said wall with which said reinforcing layer is in contact.

3. A new article comprising a cylindrical container with a sterilized product confined therewithin and having a pressure differential between the interior and exterior of the container, comprising:

a cylindrical body having a circumferential wall;

said cylindrical body having a bottom closing off one end of said container to leave the opposite end of the container open and to define a space within which said product is received;

a lid sealing said open opposite end of the container to confine said product therein with the product and container being at a residual elevated temperature from pasteurization or other sterilization process whereby cooling of the sealed container thereafter produces said pressure differential;

said lid and said bottom being substantially parallel so that the container may be stacked;

the circumferential wall being sufficiently thin that said pressure differential tends to deform said cylindrical wall and thereby destroy said substantially parallel relation between said lid and said bottom;

a layer of relatively flexible material encompassing at least the intermediate girth of said circumferential wall, said layer itself being more flexible than said circumferential wall; and adhesive means for securing said layer of material to said wall such that the layer and the wall cooperate to provide sufficient strength to withstand said differential pressure without deformation of the container.

* * * * *